US008402962B2

(12) United States Patent
Kim et al.

(10) Patent No.: US 8,402,962 B2
(45) Date of Patent: Mar. 26, 2013

(54) APPARATUS FOR SUPPLY MIXED GAS FOR GAS BURNERS OF RADIANT HEATING TYPE

(75) Inventors: Young Soo Kim, Changwon-si (KR); Dae Hee Jung, Changwon-si (KR); Dae Rae Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1024 days.

(21) Appl. No.: 10/584,891

(22) PCT Filed: Dec. 29, 2003

(86) PCT No.: PCT/KR03/02866

§ 371 (c)(1),
(2), (4) Date: Sep. 4, 2007

(87) PCT Pub. No.: WO2005/064234

PCT Pub. Date: Jul. 14, 2005

(65) Prior Publication Data

US 2010/0206304 A1 Aug. 19, 2010

(51) Int. Cl.
*F24C 3/00* (2006.01)

(52) U.S. Cl. ..... 126/39 E; 126/15 A; 126/39 J; 126/39 R; 126/92 AC

(58) Field of Classification Search ..... 126/39 R–39 M, 126/92 AC, 15 R, 15 A; 431/354, 266, 328, 431/329

See application file for complete search history.

(56) References Cited

U.S. PATENT DOCUMENTS

| | | | | | |
|---|---|---|---|---|---|
| 613,871 | A | * | 11/1898 | Webb | 431/110 |
| 1,466,356 | A | * | 8/1923 | Eddison | 431/12 |
| 2,494,243 | A | * | 1/1950 | Houlis | 239/414 |
| 2,908,267 | A | * | 10/1959 | Hess | 126/299 R |
| 3,114,410 | A | * | 12/1963 | Schneider | 431/285 |
| 3,198,238 | A | * | 8/1965 | Hughes | 431/349 |
| 3,606,612 | A | * | 9/1971 | Reid, Jr. | 431/281 |
| 3,633,562 | A | * | 1/1972 | Morse et al. | 126/39 J |
| 3,662,735 | A | * | 5/1972 | Jackson | 126/85 B |
| 3,844,707 | A | * | 10/1974 | Wormser | 431/347 |

(Continued)

FOREIGN PATENT DOCUMENTS

| | | | |
|---|---|---|---|
| DE | 3315745 | | 10/1984 |
| EP | 0180458 B1 | * | 5/1986 |

(Continued)

*Primary Examiner* — Steven B McAllister
*Assistant Examiner* — Desmond Peyton
(74) *Attorney, Agent, or Firm* — Ked & Associates LLP

(57) ABSTRACT

Device for supplying mixed gas to gas burners of radiant heating type including a plurality of burner assemblies (310) in the housing (301) for combustion of the mixed gas therein, each with a burner chamber (312) for supplying mixed gas of fuel gas and air thereto, a glass plate (302) placed on top of the housing (301), a plurality of mixing tubes (321) respectively in communication with the burner chamber (312) for supplying the fuel gas and the air thereto, a plurality of gas nozzles (322) for respectively spraying the fuel gas into the mixing tubes (321), a plurality of air supply tubes (323) for respectively spraying the fuel gas into the mixing tubes (321), a plurality of air supply tubes (323) each spaced a distance away from the other end of one of the mixing tubes (321), for supplying air toward the one of the mixing tubes (321), and a fan unit (330) connected to an end of one of the air supply tubes (323) for supplying air thereto.

18 Claims, 12 Drawing Sheets

U.S. PATENT DOCUMENTS

| | | | | | |
|---|---|---|---|---|---|
| 4,083,355 | A | * | 4/1978 | Schwank | 126/39 J |
| 4,569,328 | A | * | 2/1986 | Shukla et al. | 126/39 J |
| 4,580,550 | A | * | 4/1986 | Kristen et al. | 126/39 J |
| 4,588,375 | A | * | 5/1986 | Sandstrom | 431/354 |
| 4,664,620 | A | * | 5/1987 | Kendall et al. | 431/328 |
| 4,665,893 | A | * | 5/1987 | Miyagawa et al. | 126/299 D |
| 4,788,962 | A | * | 12/1988 | Mashburn et al. | 126/25 R |
| 5,035,609 | A | * | 7/1991 | Riehl | 431/286 |
| 5,108,284 | A | * | 4/1992 | Gruswitz | 431/286 |
| 5,131,839 | A | * | 7/1992 | Riehl | 431/286 |
| 5,154,160 | A | * | 10/1992 | Burtea et al. | 126/21 A |
| 5,186,620 | A | * | 2/1993 | Hollingshead | 431/354 |
| 5,193,273 | A | * | 3/1993 | Riehl | 29/890.01 |
| 5,209,217 | A | * | 5/1993 | Beach et al. | 126/39 R |
| 5,213,091 | A | * | 5/1993 | Beach | 126/299 D |
| 5,286,190 | A | * | 2/1994 | Riehl | 431/286 |
| 5,297,955 | A | * | 3/1994 | Riehl | 431/286 |
| 5,325,842 | A | * | 7/1994 | Beach et al. | 126/39 R |
| 5,400,765 | A | * | 3/1995 | Goldstein et al. | 126/39 J |
| 5,425,353 | A | * | 6/1995 | Herbert | 126/39 N |
| 5,431,557 | A | * | 7/1995 | Hamos | 431/7 |
| 5,509,403 | A | * | 4/1996 | Kahlke et al. | 126/39 E |
| 5,593,300 | A | * | 1/1997 | de Gouville | 431/328 |
| 6,027,336 | A | * | 2/2000 | Nolte et al. | 431/354 |
| 6,076,517 | A | * | 6/2000 | Kahlke et al. | 126/39 J |
| 6,261,089 | B1 | * | 7/2001 | Aldo | 431/354 |
| 6,364,657 | B1 | * | 4/2002 | O'Donnell | 431/354 |
| 6,478,577 | B1 | * | 11/2002 | Maricic et al. | 431/353 |
| 6,736,634 | B2 | * | 5/2004 | Manohar et al. | 431/328 |
| 6,918,194 | B2 | * | 7/2005 | Freese et al. | 34/604 |
| 7,252,503 | B2 | * | 8/2007 | Mashburn | 431/114 |
| 7,481,210 | B2 | * | 1/2009 | Kim et al. | 126/39 B |
| 2005/0016520 | A1 | * | 1/2005 | Freese et al. | 126/91 A |
| 2005/0037305 | A1 | * | 2/2005 | Moriya et al. | 431/284 |
| 2005/0050766 | A1 | * | 3/2005 | Freese et al. | 34/604 |

FOREIGN PATENT DOCUMENTS

| | | |
|---|---|---|
| EP | 0423493 | 4/1991 |

* cited by examiner

APPARATUS FOR SUPPLY MIXED GAS FOR GAS BURNERS OF RADIANT HEATING TYPE

TECHNICAL FIELD

The present invention relates to devices for supplying mixed gas of air and gas to gas burners, and more particularly, to a device for supplying mixed gas to gas burners of radiant heating type, that heats with radiant heat transmitted through a glass plate, in which, in supplying mixed gas of air and gas to a gas burner, regulation of an air flow rate according to gas flow rate is easy, for providing an enough flow rate of air required for combustion to the gas burner.

BACKGROUND ART

The gas burner of radiant heating type is a gas burner in which a heating object is heated, and cooked with a radiant wave from a heated radiant body caused by combustion of mixed gas of fuel and air.

FIG. 1 illustrates a perspective view of an example of a related art gas oven range employing gas burners of radiant heating type, and FIG. 2 illustrates a diagram showing a system of a gas burner of radiant heating type in the gas oven range.

The related art gas oven range is provided with an oven part 100 for barbecuing or baking by using direct heat and heat convection, a grill part 200 over the oven part 100 for grilling fish to brown by using heat convection, a top burner part 300 over the grill part 200 for heating food or a container containing food, and a back guide part 400 in rear of the gas oven range for discharging exhaust gas from the oven part 100, the grill part 200, and the top burner part 300.

The top burner part 300 is provided with a plurality of burner assemblies 310 in a housing (not shown), and a ceramic glass plate 302 on top of the housing 301 for closing tops of the burner assemblies 310.

Referring to FIG. 2, the burner assembly 310 is provided with a burner housing 311 closed with the ceramic glass plate 302 to form a burning space, a burner chamber having a burner pot 312 mounted on an underside of the burner housing 311 for mixing gas and air, and a burner mat 313 on top of the burner pot 312.

In general, closed with the ceramic glass plate 302, the burner assembly 310 of radiant heating type has no natural air supply from an outside of the burner assembly 310, and is involved in shortage of combustion air.

To cope with this in the related art, for supplying mixed gas of fuel gas and an adequate air into the burner pot 312 of the burner assembly 310, the burner pot 312 is provided with one side in communication with the mixing tube 390, and the mixing tube 390 is provided with a gas nozzle 391 connected to a middle part thereof for spraying fuel gas, and a fan 392 and a fan motor 393 at an end thereof for enforced supply of air, for supplying fuel gas and air through the mixing tube 390.

However, the enforced supply of air and fuel gas to the burner pot 312 through the mixing tube 390, resulting to supply air at a fixed air flow rate thereto with the fan 392, causes a problem in that flame can not be controlled as desired because the air flow rate cannot be controlled according to variation of gas supply rate.

Therefore, the related art burner assembly controlled the air flow rate according to variation of gas supply rate, by using a BLDC motor as the fan motor, of which speed is variable, and providing a sensor for detecting user's operation of flame control knob, for varying rotation speed of the fan according to the operation of the flame control knob, to control the air flow rate.

However, in this case, the use of a plurality of expensive BLDC motors pushes up a cost of the burner assembly, and the additional fitting of the flame control knob and the like results to a complicated structure, together with difficulty in control.

In the meantime, U.S. Pat. No. 6,076,517 discloses gas burners of radiant heating type, in which a chamber is provided in a housing of a top burner part, which is in communication with a mixing tube of each burner, and a fan is provided for forced supply of external air to the chamber, to build up a high pressure inside of the chamber, and introduce air into the mixing tubes, for supplying adequate combustion air.

However, since the gas burners of radiant heating type has a system in which the air is supplied to the chamber forcibly through a mixing tube of each gas burner alike above gas burners of radiant heating type, the gas burners of radiant heating type require to vary an air flow rate to the chamber for controlling the air flow rate according to the gas supply rate to the gas burners, resulting to require expensive a variable speed motor such as the BLDC motor as a fan motor for driving a fan, as well as a sensor for automatic sensing of an extent of gas supply rate control.

Moreover, since control of an air flow rate to each burner is very difficult in a case a plurality of gas burners are used at the same time, the gas burners of radiant heating type have structural problems in that a fan and a fan motor are provided to every gas burner individually, or opening of a passage therein is controlled individually.

DISCLOSURE OF INVENTION

An object of the present invention devised to solve the foregoing problems lies on providing a device for supplying mixed gas to gas burners of radiant heating type, in which an adequate air required for combustion is supplied to the mixing tube, and an air flow rate is automatically controlled according to a gas supply rate without a sensor or the like, for achieving smooth and proper combustion.

To achieve the object of the present invention, there is provided a device for supplying mixed gas to gas burners of radiant heating type having a housing, a plurality of burner assemblies in the housing for combustion of the mixed gas therein, each with a burner chamber for supplying mixed gas of fuel gas and air thereto, and a glass plate placed on top of the housing, including a plurality of mixing tubes respectively in communication with the burner chambers for supplying the fuel gas and the air thereto, a plurality of gas nozzles for respectively spraying the fuel gas into the mixing tubes, a plurality of air supply tubes each spaced a distance away from the other end of one of the mixing tubes, for supplying air toward the one of the mixing tubes, and a fan unit connected to an end of one of the air supply tubes for supplying air thereto.

Thus, the device for supplying mixed gas to gas burners of radiant heating type of the present invention permits automatic air flow rate control according to control of a gas supply rate because an air flow rate introduced into the mixing tube varies with the gas supply rate sprayed into the mixing tube from the gas nozzle as an end of the mixing tube is opened, in addition to the adequate air supply into the mixing tube through the air supply tube.

In other aspect of the present invention, there is provided a device for supplying mixed gas to gas burners of radiant heating type having a housing, a plurality of burner assemblies in the housing for combustion of the mixed gas therein, each with a burner chamber for supplying mixed gas of fuel gas and air thereto, and a glass plate placed on top of the housing, including a plurality of mixing tubes respectively in communication with the burner chambers for supplying the fuel gas and the air thereto, a plurality of gas nozzles for respectively spraying the fuel gas into the mixing tubes, a plurality of air supply tubes each spaced a distance away from the other end of one of the mixing tubes, for supplying air toward the one of the mixing tubes, a fan unit for supplying air to the air supply tubes, and at least one air supply chamber between the air supply tubes and the fan unit for receiving air from the fan unit and supplying the air to the air supply tubes.

Thus, this embodiment permits to supply adequate air even with a small air flow rate because air from the fan unit is supplied to the air supply tube pressurized through the air supply chamber.

In another aspect of the present invention, there is provided a device for supplying mixed gas to gas burners of radiant heating type having a housing, a plurality of burner assemblies in the housing for combustion of the mixed gas therein, each with a burner chamber for supplying mixed gas of fuel gas and air thereto, and a glass plate placed on top of the housing, including a plurality of mixing tubes respectively in communication with the burner chambers for supplying the fuel gas and the air thereto, a plurality of gas nozzles for respectively spraying the fuel gas into the mixing tubes, a plurality of air supply tubes each having one end spaced a distance away from the other end of one of the mixing tubes, for supplying air to the one of the mixing tubes, a fan unit for supplying air, and at least one branch tube having one end connected to the fan unit, and the other end connected to a plurality of the air supply tubes for distributing air from the fan unit to the plurality of air supply tubes.

Thus, this embodiment has advantage in that a number of fan units can be minimized, and air can be supplied according to a capacity of each of the burner assemblies because the air supply tube is branched and extended to respective burner assemblies.

In further aspect of the present invention, there is provided a device for supplying mixed gas to gas burners of radiant heating type having a housing, a plurality of burner assemblies in the housing for combustion of the mixed gas therein, each with a burner chamber for supplying mixed gas of fuel gas and air thereto, and a glass plate placed on top of the housing, including a mixing tube assembly including a mixing tube having one end in communication with the burner chamber for supplying fuel gas and air to the burner chamber, an air supply tube formed as one unit with the mixing tube on an outside of the mixing tube such that one end thereof is spaced a distance away from the other end of the mixing tube for supplying air to the mixing tube, and a connecting member for connecting the mixing tube and the air supply tube as one unit, a gas nozzle at a position spaced a distance away from the mixing tube for spraying gas toward the mixing tube, and a fan unit for blowing air to the air supply tube.

Thus, the present invention permits easy mounting, replacement, and maintenance of the burner assembly, because the mixing tube and the air supply tube are provided a unitized assembly.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. In describing the embodiments, same parts will be given the same names and reference symbols, and repetitive description of which will be omitted.

FIGS. 3~6 illustrate diagrams showing gas burners of radiant heating type and mixed gas supplying devices of the present invention.

Figure 3:
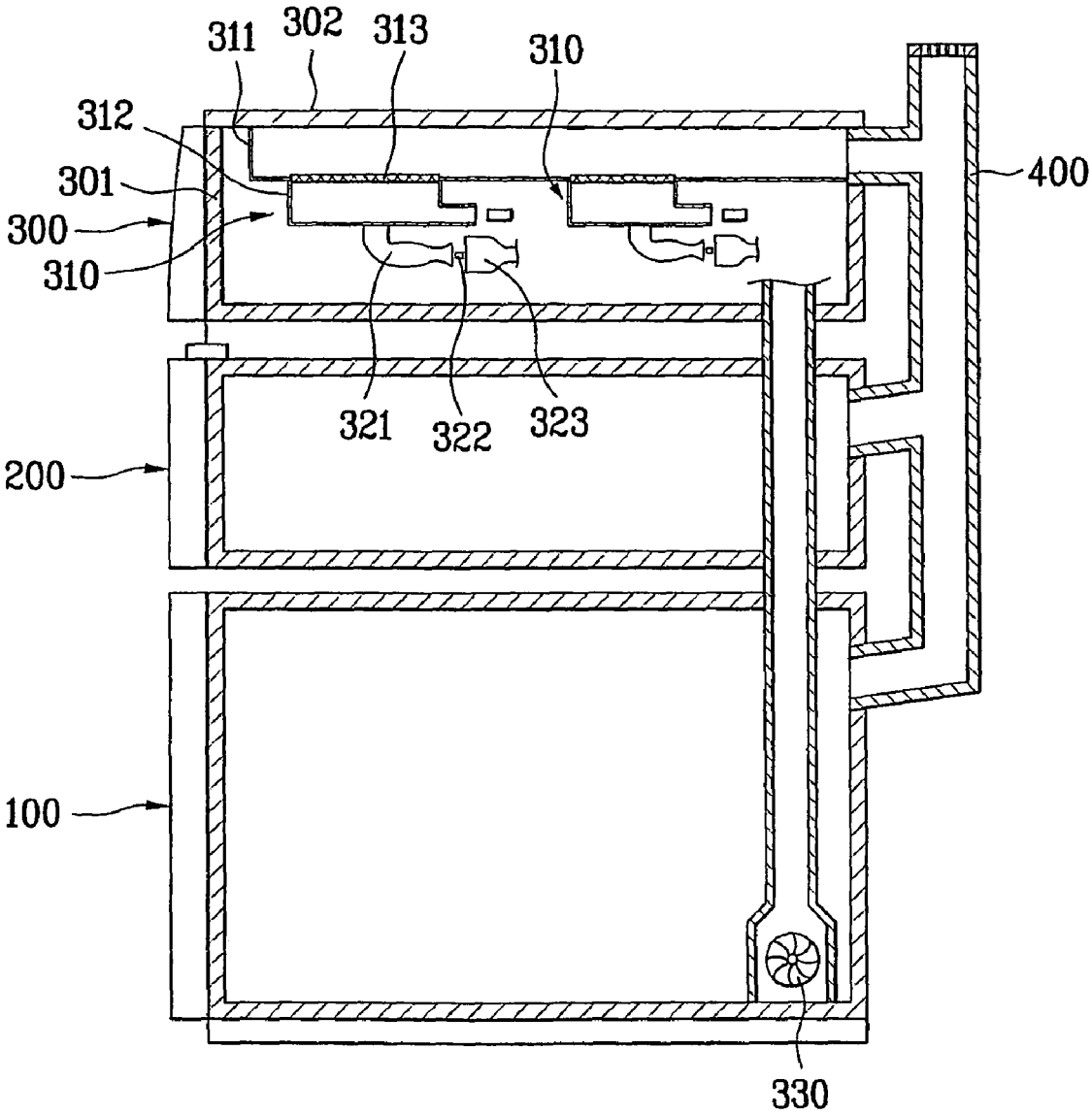
FIG. 3 illustrates a section of key parts of gas burners of radiant heating type in accordance with a preferred embodiment of the present invention, schematically.

Referring to FIG. 3, the gas burners of radiant heating type includes an oven part 100 for barbecuing or baking by using direct heat and heat convection, a grill part 200 over the oven part 100 for grilling fish to brown by using heat convection, a top burner part 300 over the grill part 200 for heating food or a container containing food, and a back guide part 400 in rear of the gas oven range for discharging exhaust gas from the oven part 100, the grill part 200, and the top burner part 300.

The top burner part 300 includes a plurality of burner assemblies 310 in a housing (not shown), and a ceramic glass plate 302 on top of the housing 301 for closing tops of the burner assemblies 310.

Figure 4:
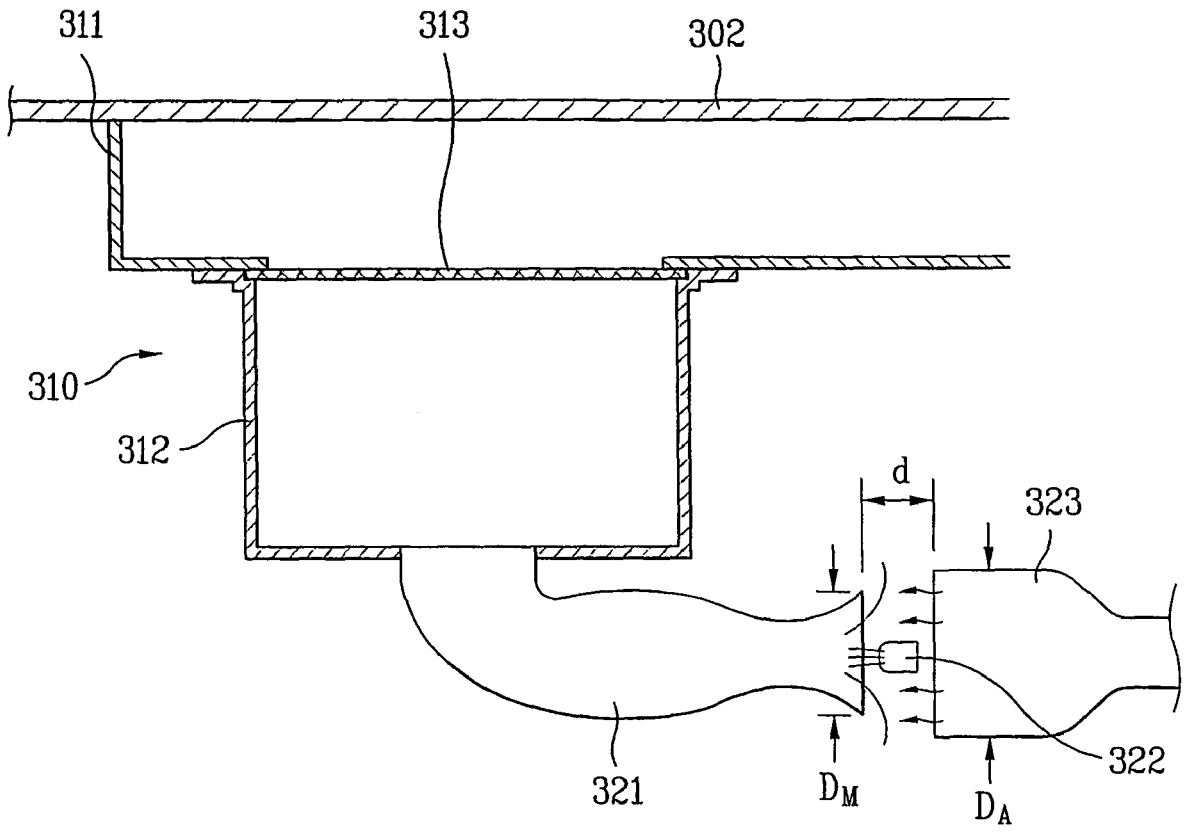
FIG. 4 illustrates a section of key parts of a burner assembly and a mixing gas supplying device in the gas burners of radiant heating type in FIG. 3.

Referring to FIG. 4, the burner assembly 310 includes a burner housing 311 closed with the ceramic glass plate 302 to form a burning space, a burner chamber having a burner pot 312 mounted on an underside of the burner housing 311 for mixing gas and air, and a burner mat 313 on top of the burner pot 312 to form a combustion surface.

The burner pot 312 has a mixing tube 321 with one end in communication with the burner pot 312, and the other end opened. The mixing tube 321 has an inside diameter of the other end reduced to form a throttle, for generating a pressure difference between the opened outside and the throttle part.

In the meantime, there is a gas nozzle 322 provided to the outside of the other end of the mixing tube 321 for spraying fuel gas to the mixing tube 321. Alike this embodiment, the gas nozzle 322 may be provided to the outside of the other end of the mixing tube 321, different from this, the gas nozzle 322 is be inserted in the mixing tube 321.

There is an air supply tube 323 at an outside of the other end of each of the opened mixing tubes 321, for supplying air from the fan 330 to the mixing tube 321. It is required that the air supply tube 323 is spaced a distance from the other end of the mixing tube 321 in a length direction for forming a space between an end of the mixing tube 321 and an end of the air supply tube 323, for free introduction of external air into the mixing tube 321.

Figure 5:
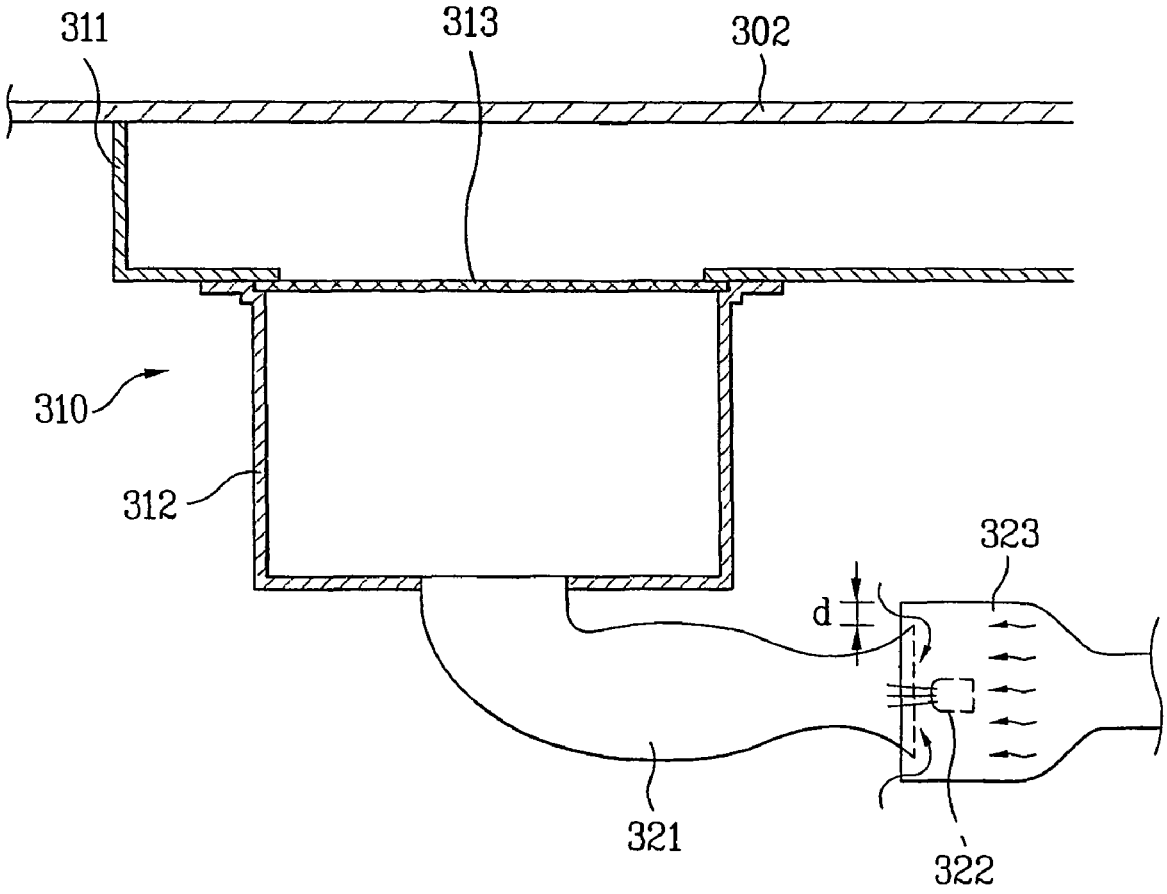
FIG. 5 illustrates a section of key parts of a burner assembly and a mixing gas supplying device in the gas burners of radiant heating type in FIG. 3 in accordance with other preferred embodiment of the present invention.

Even though it is described in this embodiment that the air supply tube 323 is spaced from the end of the mixing tube 321 in a length direction, different from this, as shown in FIG. 5, the ends of the air supply tube 323 and the mixing tube 321 may be spaced, not in the length direction, but in a radial direction by a distance 'd'.

Moreover, though the fan 330 and the fan motor 331 for supplying air to the air supply tube 323 may be provided in the housing, it is preferable that the fan 330 and the fan motor 331 are provided on an outside of the housing 301 as shown in FIG. 3*for* avoiding a thermal load in the housing. It is more preferable that the end of the air supply tube 323 facing the mixing tube 321 has a diameter becoming greater than other part to have an expanded tube form, for reducing air speed at the end of the air supply tube 323 to an influence when external air is introduced from an outside of the mixing tube 321 by the pressure difference.

Figure 6:
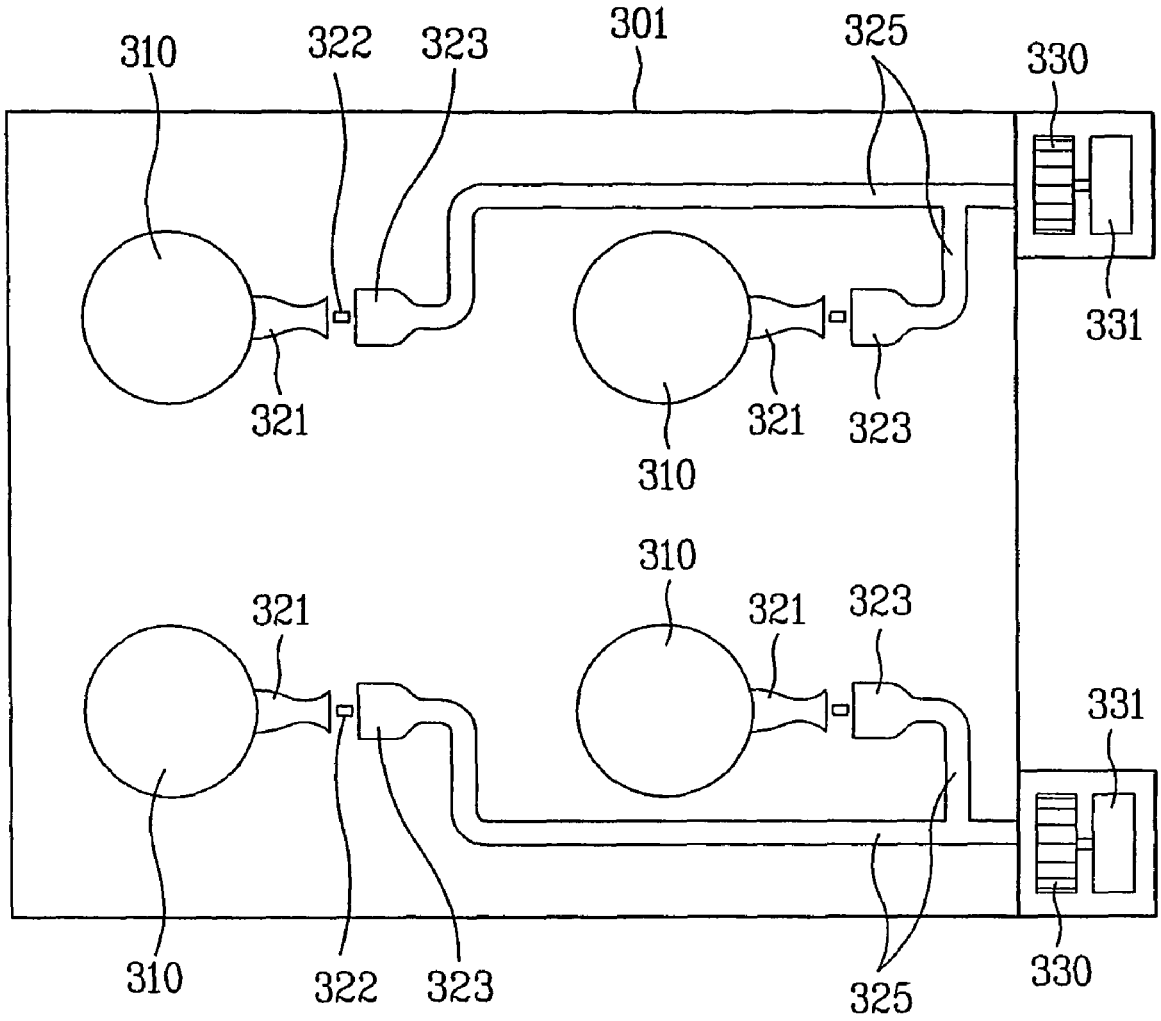
FIG. 6 illustrates a plan view of a mixing gas supplying device in the gas burners of radiant heating type in FIG. 3, schematically.

Referring to FIG. 6, for supplying air to the air supply tubes 323, each of two sets of branch tubes 325 each set having one end connected to one of the fans 330 may be branched into two and connected two air supply tubes 323 in the burner assembly 310, respectively.

Figure 7:
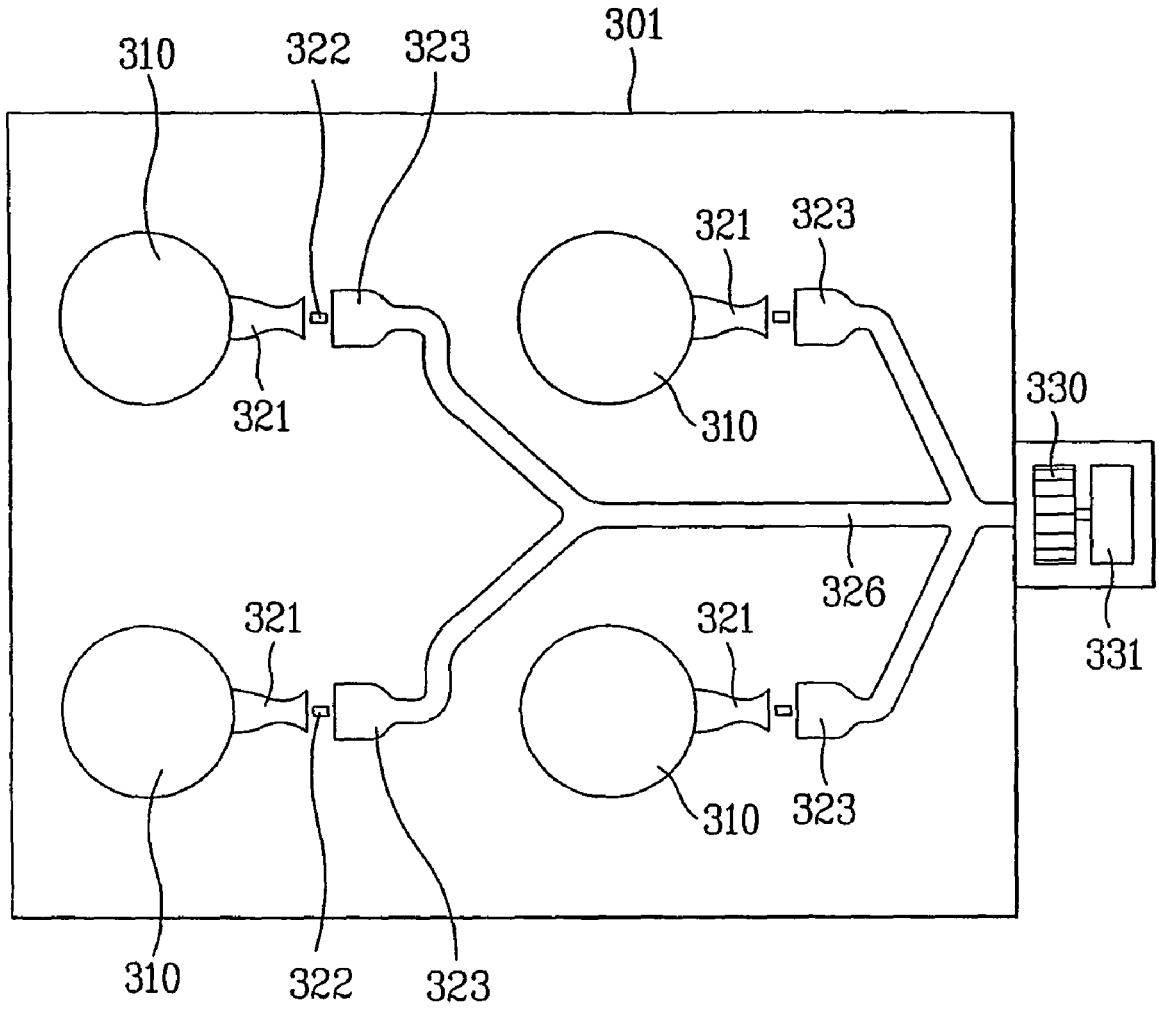
FIG. 7 illustrates a plan view of a variation of the gas burners of radiant heating type in FIG. 6.

Of course, referring to FIG. 7, different from this, one branch tube 326 may be branched to four branch tubes and connected to the air supply tubes 323 in the burner assembly 310.

The operation of the device for supplying mixed gas to gas burners of radiant heating type of the present invention will be described with reference to FIGS. 3~6.

Figure 1:
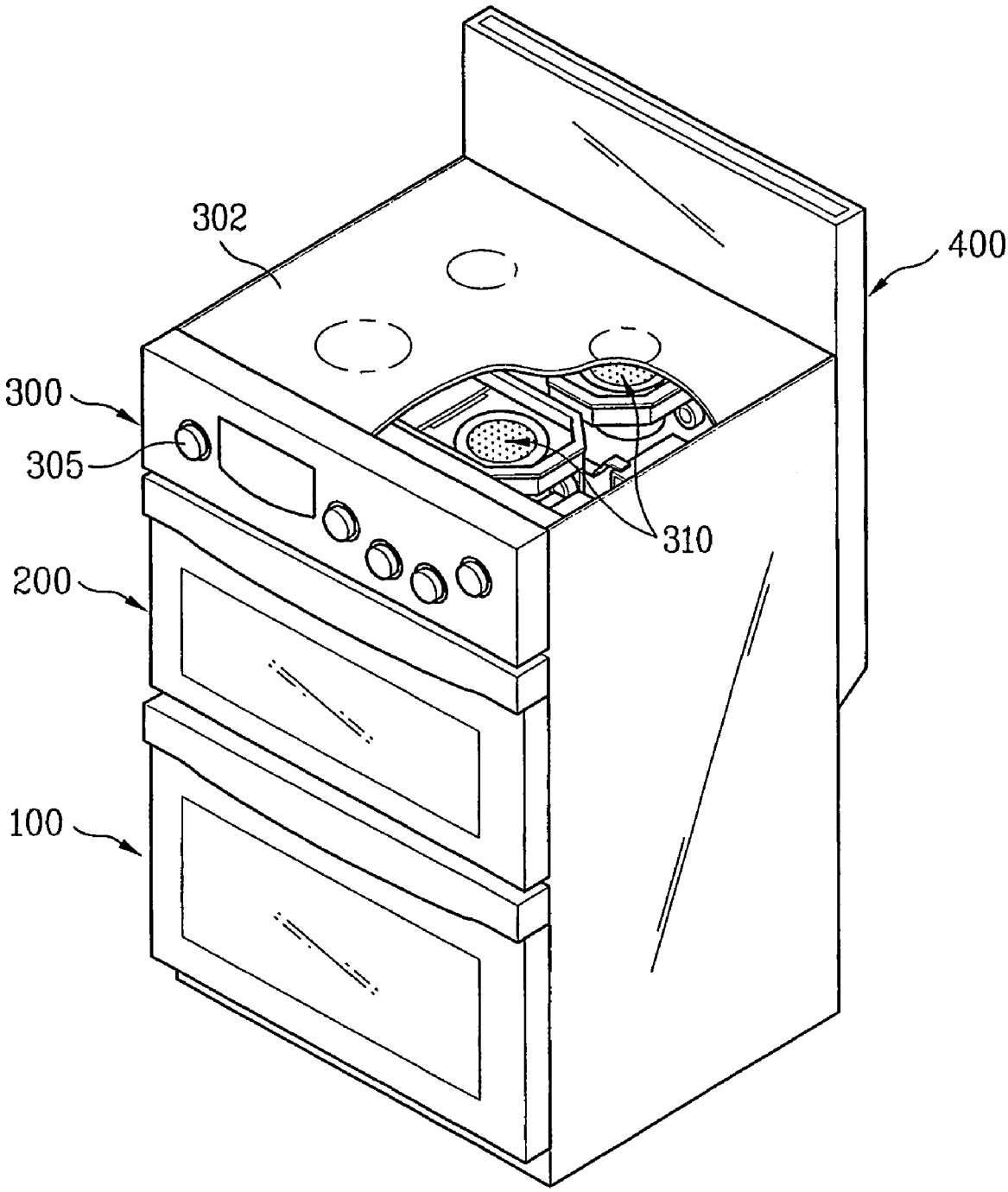
FIG. 1 illustrates a perspective view with a partial cut away view of a related art gas oven range with gas burners of radiant heating type.

When a user places a cooking object on the ceramic glass plate 302 and operates the flame control knob 305 (see FIG. 1), fuel gas is sprayed toward the mixing tube 321 through the gas nozzle 322 at a high speed.

In this instance, the high speed spray of the fuel gas drops neighborhood pressure resulting to introduce external air into the mixing tube 321, together with the fuel gas. The air and fuel gas introduced into the mixing tube 321 pass through the throttle, and are involved in speed increase together with pressure drop at this part, to cause a pressure difference from the end of the mixing tube 321, and consequential continuous introduction of external air from an outside of the end of the mixing tube 321 into the mixing tube 321, which can be expected well in view of the Bernoulli's theorem.

Along with this, the fan 330 comes into operation, to draw, and blow external air to the air supply tube 323, and therefrom to the mixing tube 321. According to this, in the mixing tube 321, there is the air introduced thereto by the pressure difference caused by the fuel gas spray as well as the air introduced thereto through the air supply tube 323, resulting to supply adequate air to the burner pot 312.

Figure 2:
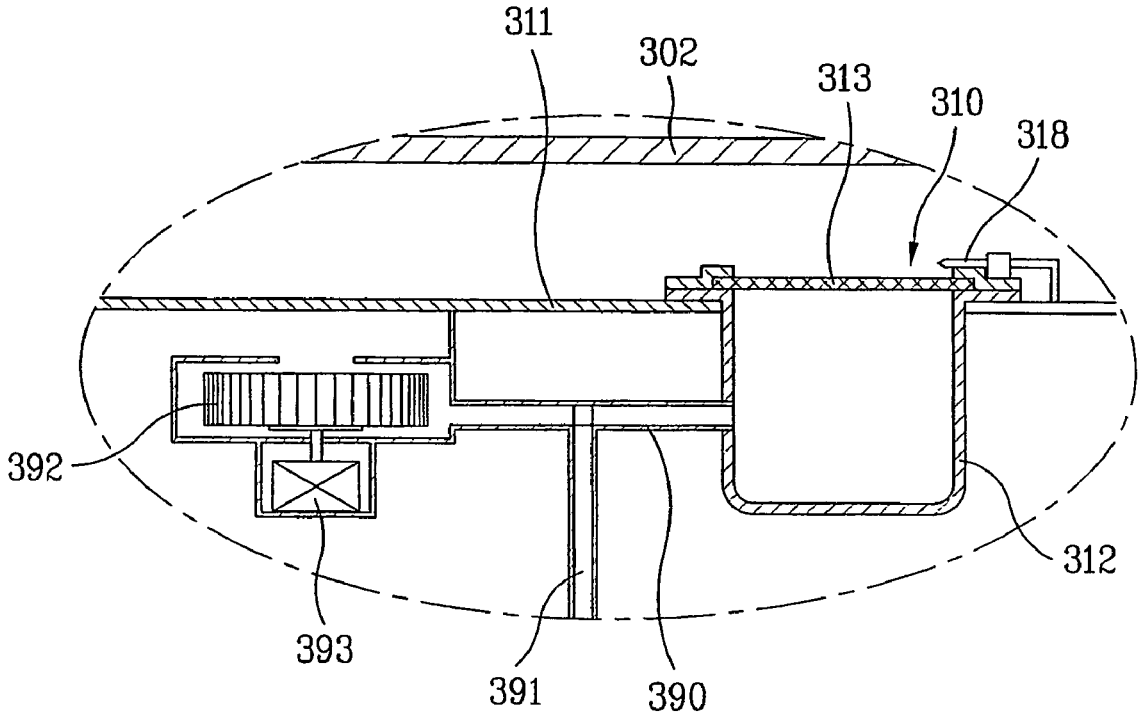
FIG. 2 illustrates a disassembled view of a related art gas burner of radiant heating type.

The fuel gas and air supplied into the burner pot 312 is mixed in the burner pot 312, passes through the burner mat 313, ignited with a flame detection and igniting means 318 (see FIG. 2), and burned. Exhaust gas is discharged to the back guide part 400 (see FIG. 3) through an opened side of the burner housing 311.

In the meantime, in a case the user controls the flame control knob for controlling a flame, for an example, in a direction the flame is reduced, the gas supply rate sprayed through the gas nozzle 322 is reduced, according to the air flow rate introduced thereto from an outside of the gas burner caused by the fuel gas spray is reduced, accordingly.

According to this, entire air flow rate supplied to the mixing tube 321 is reduced in proportion to the gas supply rate through the gas nozzle 322, thereby achieving the flame control, easily.

Of course, even if the air flow rate thus varies with the gas supply rate, a fixed rate of air is supplied through the air supply tube 323 additionally, an adequate combustion air is supplied to the burner pot 312, continuously.

In the meantime, even though a fixed flow rate of air can be supplied through the air supply tube 323 regardless of the variation of the gas supply rate, this may be unfavorable in a case it is intended to minimize the flame by minimizing the gas supply rate.

That is, since the flow rate of the air supplied additionally through the air supply tube 323 is constant in both of the cases the gas supply rate is maximum and minimum, there is a limitation in reducing a size of the flame even if the gas supply rate is minimized.

Therefore, in a case if it is intended to reduce the size of flame according to the minimum gas flow rate further, a variable speed fan motor 331, such as a BLDC (Brushless DC Motor), is provided for driving the fan 330, to control the air flow rate according to variation of the gas supply rate.

Figure 8:
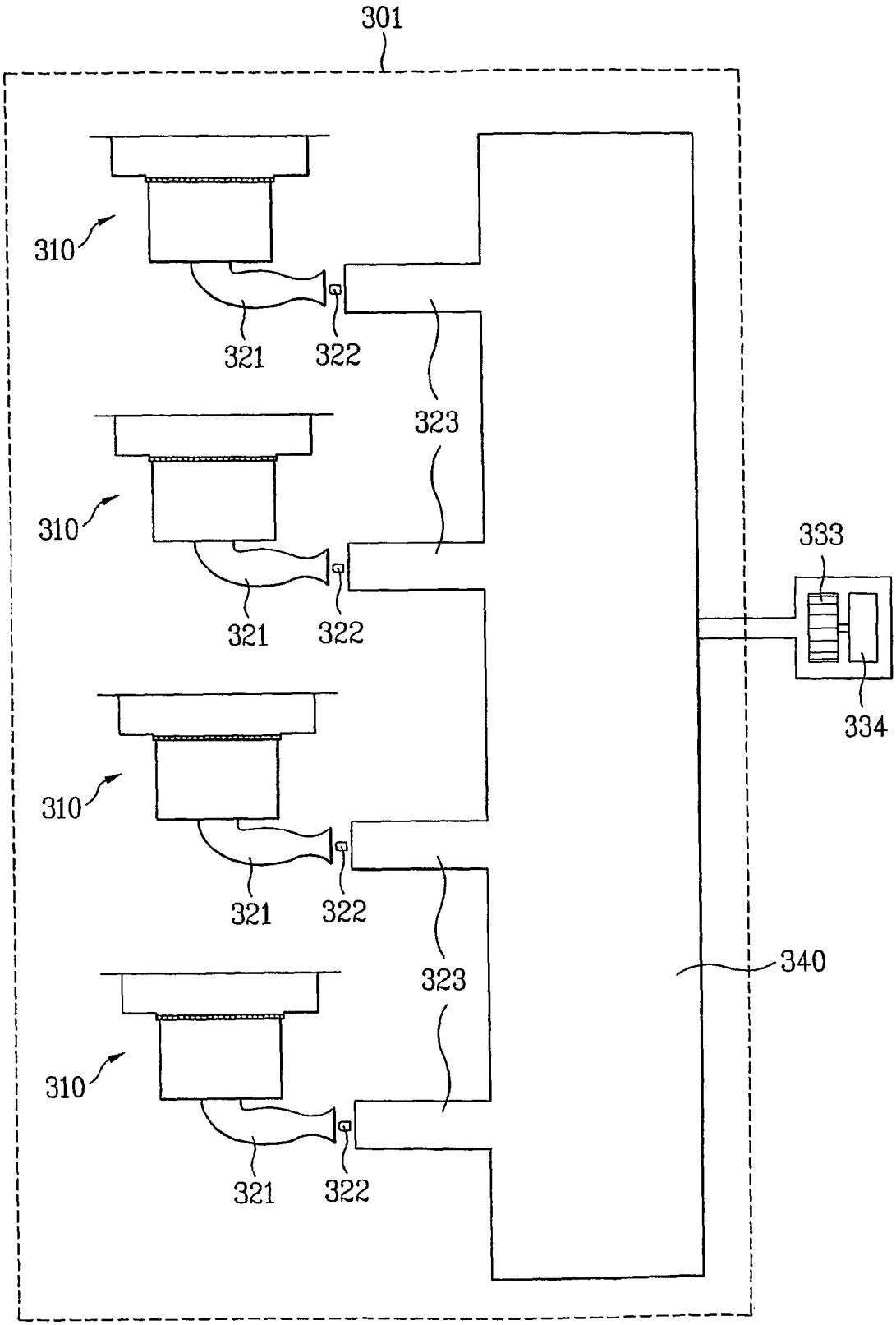
FIG. 8 illustrates a diagram of gas burners of radiant heating type in accordance with other preferred embodiment of the present invention, schematically.

FIG. 8 illustrates a diagram of a mixed gas supplying device to gas burners of radiant heating type in accordance with other preferred embodiment of the present invention, wherein the gas burners of radiant heating type includes a fan 333 and a fan motor 334 for drawing and blowing air from an outside of the housing 301, and an air supply chamber 340 between the fan 333 and the air supply tubes 323 to the burner assemblies 310.

Therefore, in this embodiment, at first, the air is supplied to, and pressurizes the air supply chamber 340 by the fan 333, and then, the high pressure air is supplied to the air supply tubes 323 to the burner assemblies 310, and therefrom to the mixing tubes 321, respectively. Even though it is preferable that the air supply chamber 340 is provided in the housing 301, different from this, the air supply chamber 340 may be partitioned on an outside of the housing separate from the housing 301.

In a case the air supply chamber 340 is arranged in the housing 301, a partition is provided across an inside of the housing, such that the partition forms an enclosed space together with an inside wall of the housing, for forming the air supply chamber 340, simply.

Moreover, referring to FIG. 8, one air supply chamber 340 may have a plurality of air supply tubes 323 connected thereto, or different from this, a plurality of air supply chambers may be connected to a plurality of air supply tubes at a time, or a plurality of air supply chambers may be connected to the air supply tubes respectively, in one to one fashion, individually.

Or, though not shown, each of the air supply tubes 323 connected to the air supply chamber 340 may be connected in a form of branch.

Figure 9:
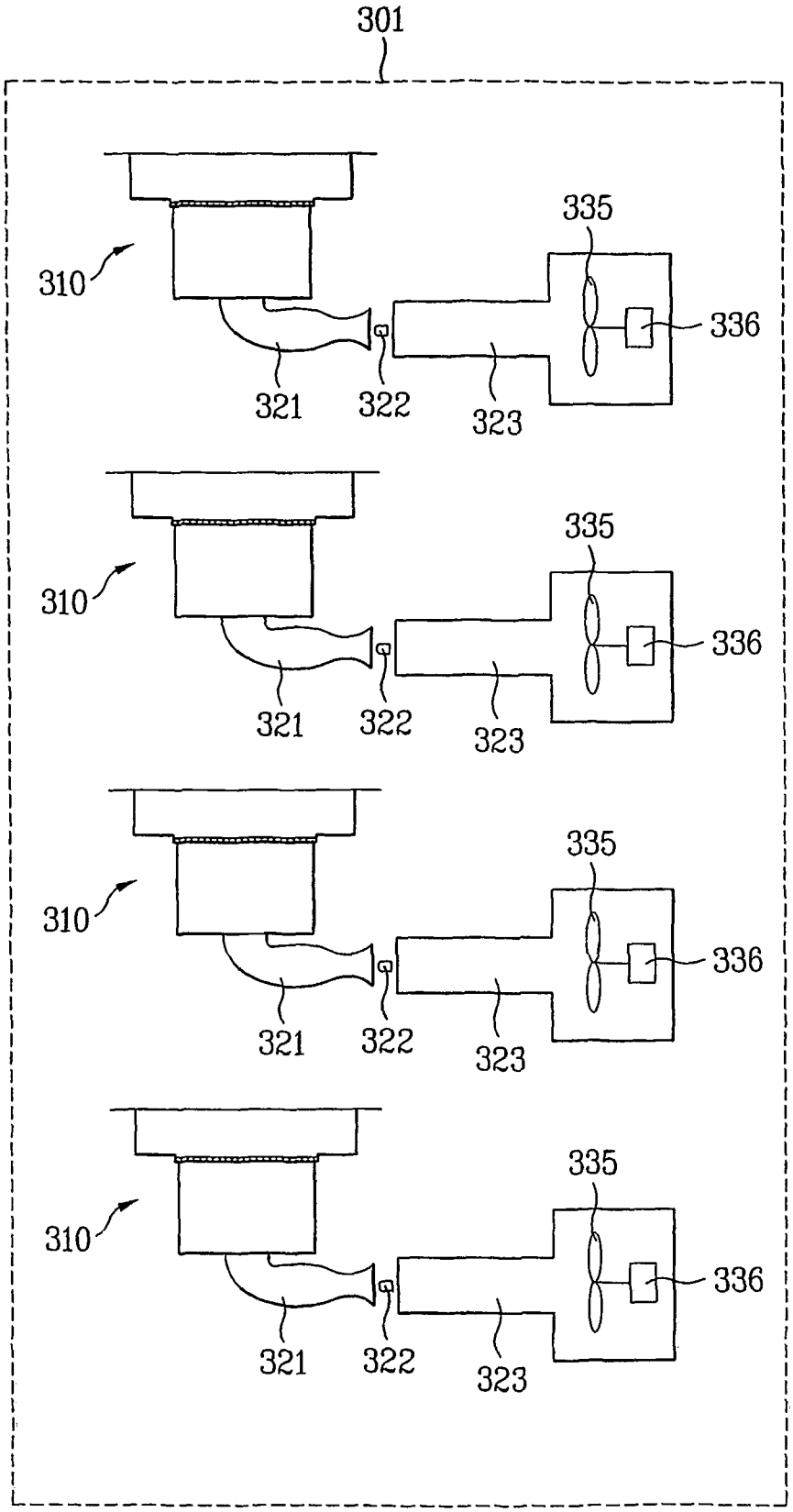
FIG. 9 illustrates a diagram of gas burners of radiant heating type in accordance with another preferred embodiment of the present invention, schematically.

FIG. 9 illustrates a mixed gas supplying device to gas burners of radiant heating type in accordance with another preferred embodiment of the present invention, wherein an air supply tube 323 is provided to an outside of the mixing tube 321 of the burner assembly 310, and a plurality of fans 335 and fan motors 336 are provided at ends of the air supply tubes 323 for supplying air to the air supply tubes 323, individually.

The mixed gas supply device of the embodiment has an advantage in that individual control can be carried out easily by setting an air flow rate supplied through each of the air supply tubes 323 according to a capacity of each of the burner assembly 310.

For an example, since a large capacity burner assembly 310 requires a high air flow rate, it is designed such that air is supplied through the air supply tube 323 to the burner assembly 310, at a high flow rate if the burner assembly 310 has a large capacity, and at a low flow rate if the burner assembly 310 has a small capacity, for providing flame corresponding to respective burner assemblies.

In the meantime, it is preferable that the mixing tube 321 and the air supply tube 323 are formed as one unit assembly, than formed as individual bodies in view of fabrication, system, and management.

Figure 10:
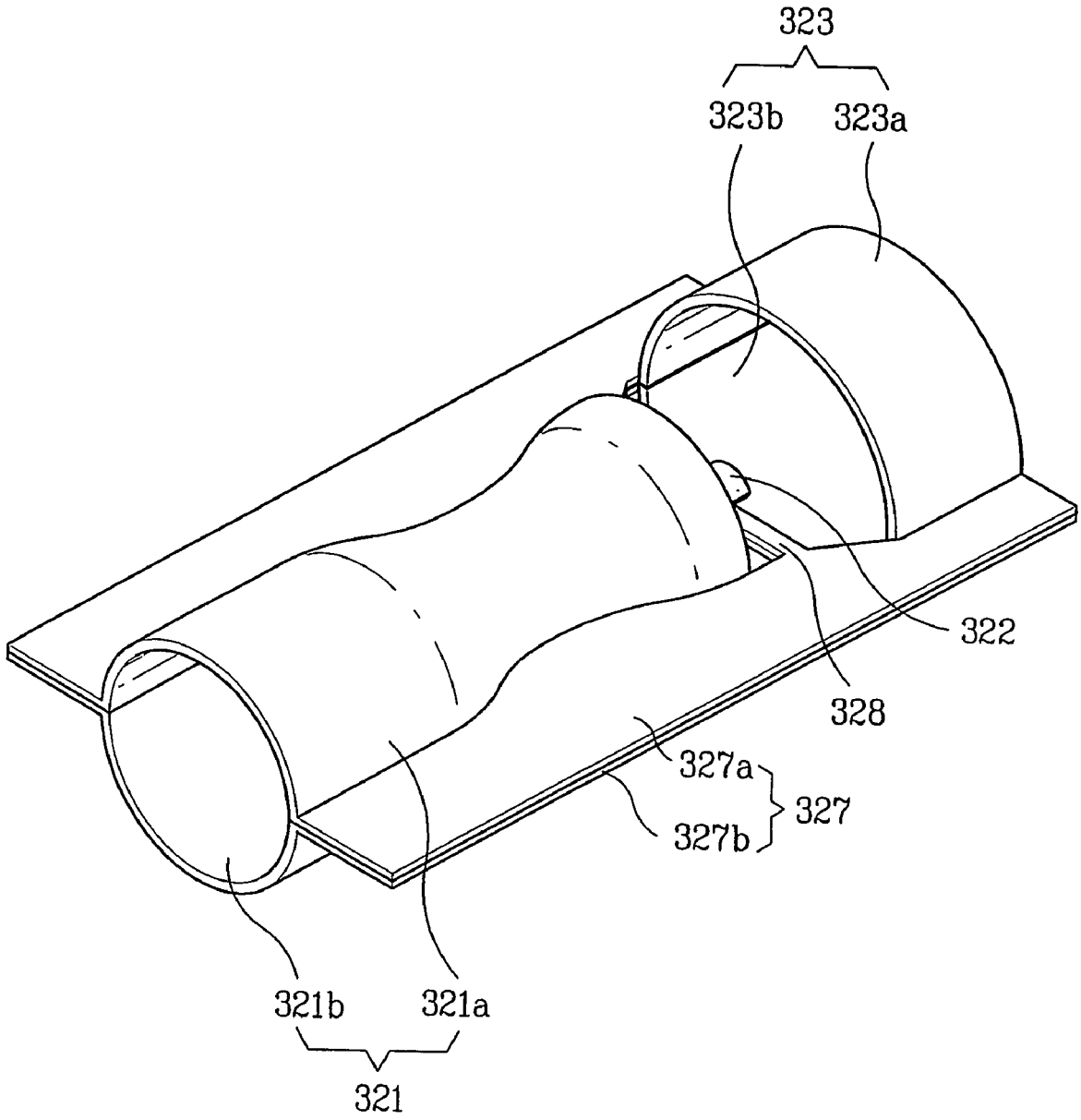
FIG. 10 illustrates a perspective view of a mixing tube assembly of a mixed gas supplying device in the gas burners of radiant heating type in accordance with another preferred embodiment of the present invention, schematically.

For an example, referring to FIG. 10, the mixing tube 321 and the air supply tube 323 may be formed as one mixing tube assembly 320 fabricated by bonding two symmetric metal members with pressing or the like.

Figure 11:
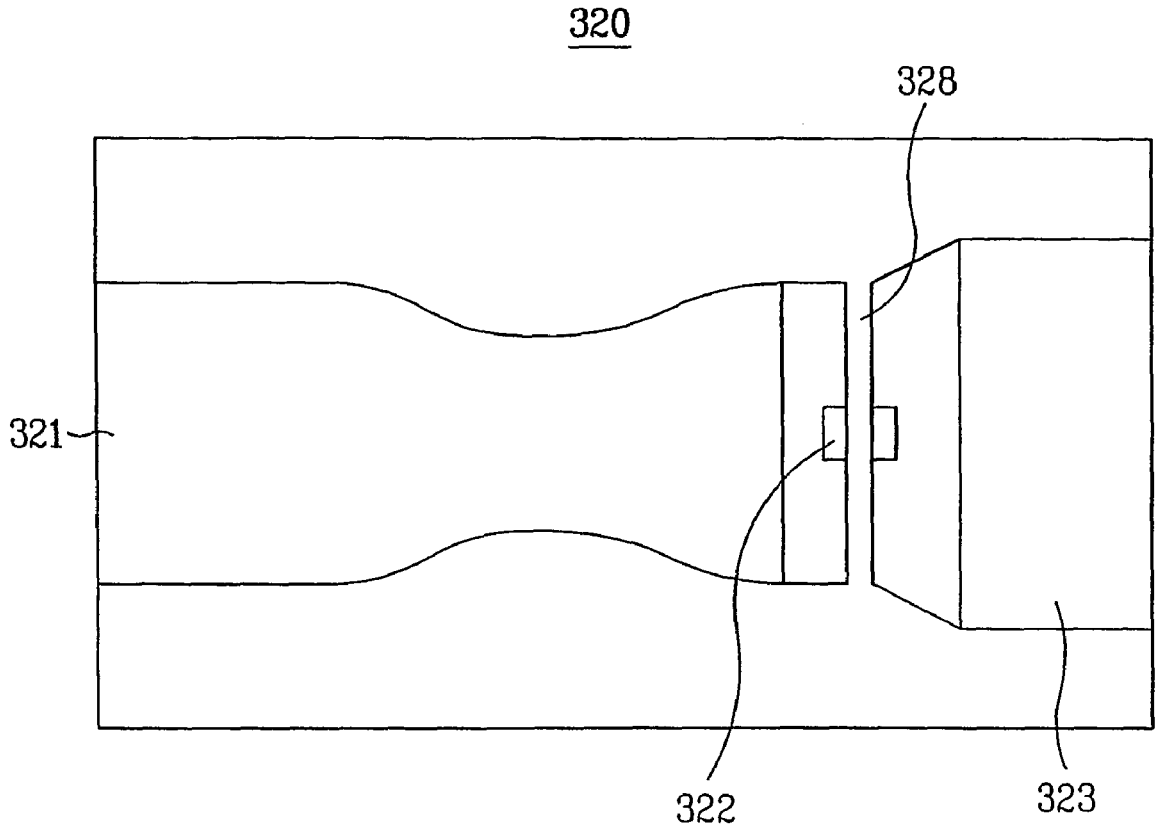
FIG. 11 illustrates a plan view of the mixing tube assembly in FIG. 10.
Figure 12:
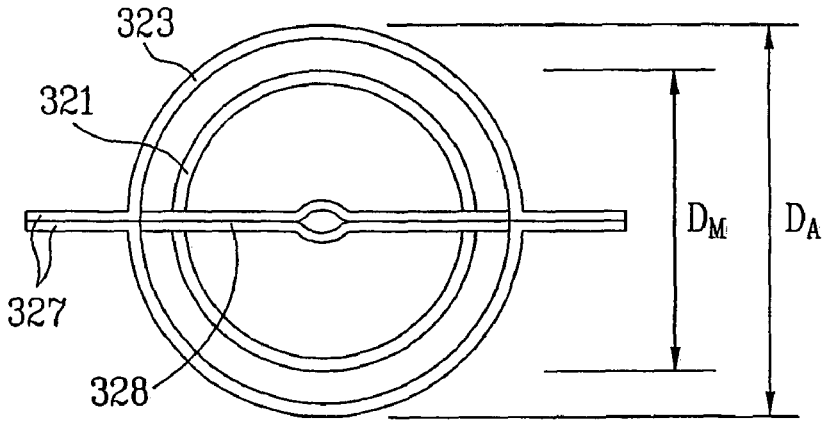
FIG. 12 illustrates a side view of the mixing tube assembly in FIG. 10.

The mixing tube assembly 320 will be described in more detail, with reference to FIGS. 10~12.

The mixing tube assembly 320 includes a first mixing tube assembly having a first mixing tube part 321*a* forming one half of the mixing tube, a first air supply tube part 323*a* forming one half of the air supply tube, and a plate form of first connection member 327*a* extended outward from both sides of the first mixing tube part 321*a* and the first air supply part 323*a* as one unit to connect the first mixing tube part and the first air supply part as one unit, and a second mixing tube assembly formed in symmetry with the first mixing tube assembly including a second mixing tube part 321*b*, a second air supply part 323*b*, and a second connecting member 327*b*.

The first mixing tube assembly and the second mixing tube assembly are united as wing forms of the first, and second connecting members 327 on both sides thereof are bonded by sheet metal working.

Moreover, it is preferable that the first, and second connecting members 327 between the mixing tube 321 and the air supply tube 323 includes a nozzle holding part 328 formed as one unit therewith for inserting and holding a gas nozzle 322.

It is preferable that the air supply tube 323 of the mixing tube assembly 320 has a diameter $D_A$ greater than a diameter $D_M$ of the mixing tube 321.

Figure 13:
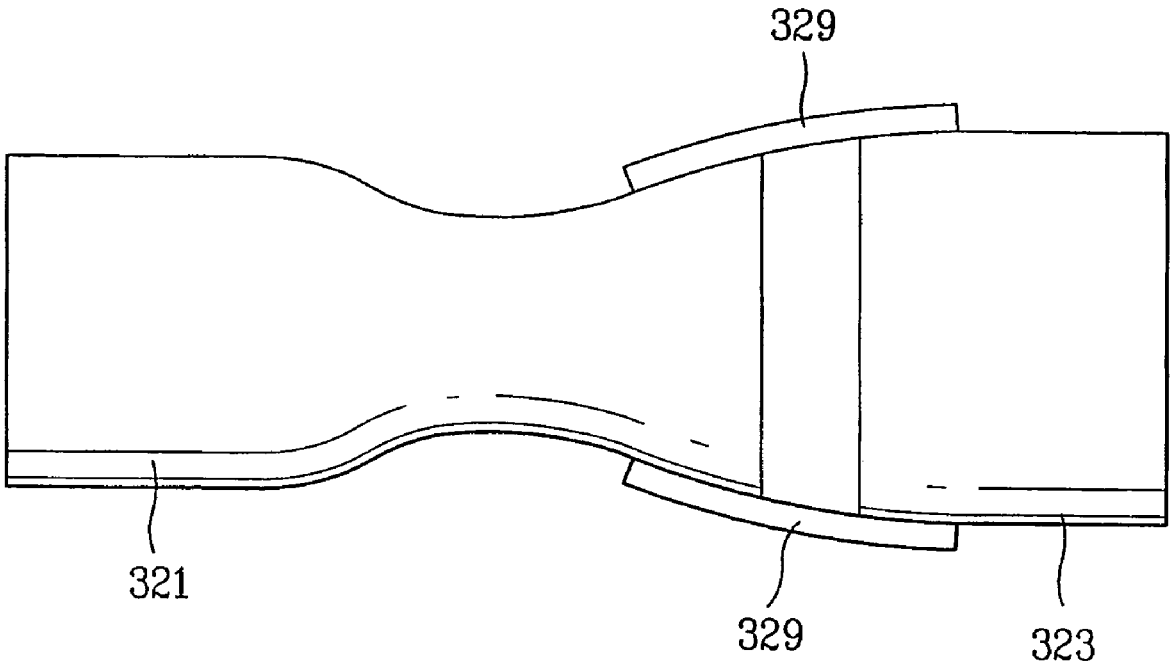
FIG. 13 illustrates a plan view of a mixing tube assembly in accordance with other preferred embodiment of the present invention.

Meanwhile, the mixing tube assembly may be unitized, not by the sheet metal working as above, but by connecting both sides of the mixing tube 321 and the air supply tube 323 with connecting members 329 as shown in FIG. 13. In this case, the connecting members 329 may be fastened to both sides of the mixing tube 321 and the air supply tube 323 with welding or with fastening means, such as screws, rivets, and the like.

Moreover, thought not shown, of course, it is also possible that the mixing tube, the air supply tube, and the connecting members are formed as one unit by injection molding or the like.

In the meantime, even though above embodiments describe that the mixing tube 321 and the air supply tube 323 correspond in one to one fashion, different from this, a plurality of air supply tubes 323 may be provided to one mixing tube 321.

As has been described, the present invention permits easy flame control and smooth combustion, because external air is drawn into the mixing tube 321 by a pressure difference at the time fuel gas is supplied to the mixing tube 321 of the burner assembly 310, as well as combustion air is supplied through the air supply tube 323 additionally, enabling to vary air supply rate with a gas supply rate.

Industrial Applicability

As has been described, radiant heating type gas burners of the present invention are applicable to gas oven ranges and gas ranges with radiant heating type gas burners, in which a heating object is heated with radiant heat generated by gas combustion.

What is claimed is:

1. A device that supplies mixed gas to radiant heating type gas burners having a housing, a plurality of burner assemblies in the housing for combustion of the mixed gas therein, each of the plurality of burner assemblies having a burner chamber that receives a mixture of fuel gas and air therein, and a glass plate placed on top of the housing, the device comprising:

a plurality of mixing tubes respectively in communication with the plurality of burner chambers for mixing the fuel gas and air and supplying the mixed fuel gas and air thereto;

a plurality of gas nozzles for respectively spraying the fuel gas into the plurality of mixing tubes;

a plurality of air supply tubes for respectively directing air toward the plurality of mixing tubes, wherein a first end of each of the plurality of mixing tubes is coupled to a corresponding burner chamber and a first end of each of the plurality of air supply tubes is coaxially aligned with a second end of a corresponding mixing tube, with a predetermined gap formed therebetween, wherein the first end of each of the plurality of air supply tubes is the end closest to the second end of each corresponding mixing tube and wherein a cross sectional area enclosed by an inner diameter of the first end of each air supply tube, facing the second end of the respective mixing tube, is greater than a cross sectional area enclosed by an inner diameter of the second end of the respective mixing tube, and wherein the predetermined gap is defined at least by a concentric annular distance extending between the inner diameter of the first end of each air supply tube and an outer diameter of the second end of the respective mixing tube;

a plurality of air passages defined by the predetermined gaps formed between the air supply tubes and the mixing tubes, wherein air outside of the plurality of mixing tubes and within the housing is drawn through the plurality of air passages and into the plurality of mixing tubes by a pressure difference between the outside and inside of the plurality of mixing tubes; and at least one fan in communication with a second end of at least one of the plurality of air supply tubes for supplying air thereto.

2. The device as claimed in claim 1, wherein the predetermined gap further comprises an axial gap formed between the first end of each air supply tube and the second end of the respective mixing.

3. The device as claimed in claim 1, wherein the at least one fan is provided at an outside of the housing.

4. The device as claimed in claim 1, further comprising at least one air supply chamber formed between the plurality of air supply tubes and the at least one fan so as to provide air from the at least one fan to the plurality of air supply tubes.

5. The device as claimed in claim 1, further comprising at least one branch tube having a first end connected to the at least one fan, and a second end in communication with the plurality of air supply tubes so as to distribute air from the at least one fan to the plurality of air supply tubes.

6. The device as claimed in claim 1, further comprising a plurality of connecting members that each connect a mixing tube of the plurality of mixing tubes to a corresponding air supply tube.

7. The device as claimed in claim 6, wherein each of the plurality of connecting members includes a nozzle holding member that holds a corresponding gas nozzle of the plurality of gas nozzles.

8. The device as claimed in claim 6, further comprising a fastening device that fastens each connecting member to a respective mixing tube and air supply tube.

9. The device as claimed in claim 6, wherein each mixing tube, corresponding air supply tube, and corresponding connecting member form a mixing tube assembly having two symmetric members bonded together.

10. The device as claimed in claim 9, wherein the mixing tube assembly comprises:

a first mixing tube assembly having a first mixing tube part forming a first half of the mixing tube, a first air supply tube part forming a first half of the air supply tube, and a plate shaped first connection member that extends outward from two opposite sides of the first mixing tube part and the first air supply part as a single unit so as to connect the first mixing tube part and the first air supply part as a single unit; and a second mixing tube assembly having a second mixing tube part forming a second half of the mixing tube, a second air supply tube part forming a second half of the air supply tube, and a plate shaped second connection member that extends outward from two opposite sides of the second mixing tube part and the second air supply part as a single unit so as to connect the second mixing tube part and the second air supply part as a single unit, wherein the second connection member is bonded with the first connection member.

11. The device as claimed in claim 6, wherein each mixing tube, corresponding air supply tube, and corresponding connecting member are injection molded as a single unit.

12. The device as claimed in claim 1, wherein a diameter of the first end of each air supply tube facing the second end of the respective mixing tube is greater than a diameter of other portions of the air supply tube so as to have an expanded tube form.

13. The device as claimed in claim 1, wherein the at least one fan includes a variable speed motor that varies a rotation speed of the at least one fan based on a gas spray rate through one or more of the plurality of gas nozzles.

14. The device as claimed in claim 1, wherein each of the plurality of mixing tubes is connected to a plurality of air supply tubes for supplying air thereto.

15. A device that supplies mixed gas to radiant heating type gas burners having a housing, a plurality of burner assemblies provided in the housing for combustion of the mixed gas therein, each of the plurality of burner assemblies having a burner chamber that receives a mixture of fuel gas and air therein, and a glass plate positioned on the housing, the device comprising:

a plurality of mixing tubes respectively in communication with the plurality of burner chambers;

a plurality of gas nozzles respectively in communication with the plurality of mixing tubes;

a plurality of air supply tubes each spaced a predetermined distance apart from and coaxially aligned with a corresponding end of a respective mixing tube of the plurality of mixing tubes, wherein a cross sectional area enclosed by an inner diameter of the first end of each air supply tube, facing the corresponding end of the respective mixing tube, is greater than a cross sectional area enclosed by an inner diameter of the corresponding end of the respective mixing tube, wherein the first end of each of the plurality of air supply tubes is the end closest to the second end of each corresponding mixing tube and wherein the predetermined gap is defined at least by a concentric annular distance extending between the inner diameter of the first end of each air supply tube and an outer diameter of the second end of the respective mixing tube;

a plurality of air passages each defined by a predetermined gap formed between one of the plurality of air supply tubes and the respective mixing tube, wherein air outside of the plurality of mixing tubes and within the housing is drawn through the plurality of air passages and into the plurality of mixing tubes by a pressure difference between the outside and inside of the plurality of mixing tubes;

at least one fan that supplies air to the plurality of air supply tubes; and at least one air supply chamber provided between the plurality of air supply tubes and the at least one fan so as to direct air from the fan to the plurality of air supply tubes.

16. The device as claimed in claim 15, wherein the air supply chamber is integrated inside of the housing.

17. The device as claimed in claim 15, wherein the air supply chamber has a plurality of air supply tubes of other burner assemblies connected thereto.

18. A device that supplies mixed gas to radiant heating type gas burners having a housing, a plurality of burner assemblies provided in the housing, each of the plurality of burner assemblies having a burner chamber that receives a mixture of fuel gas and air therein, and a glass plate positioned on the housing, the device comprising:

a plurality of mixing tubes respectively in communication with the plurality of burner chambers;

a plurality of gas nozzles respectively in communication with the plurality of mixing tubes so as to spray fuel gas therein;

a plurality of air supply tubes each coaxially aligned with a corresponding end of a respective mixing tube of the plurality of mixing tubes, wherein each of the mixing tubes is inserted into a corresponding end of a respective air supply tube, wherein a cross sectional area enclosed by an inner diameter of the first end of each air supply tube, facing the corresponding end of the respective mixing tube, is greater than a cross sectional area enclosed by an inner diameter of the corresponding end of the respective mixing tube, wherein the first end of each of the plurality of air supply tubes is the end closest to the second end of each corresponding mixing tube and wherein a predetermined concentric annular gap is defined at least by a distance extending between the inner diameter of the first end of each air supply tube and an outer diameter of the second end of the respective mixing tube;

a plurality of air passages each defined by the predetermined gap formed between one of the plurality of air supply tubes and its respective mixing tube, wherein air outside of the plurality of mixing tubes and within the housing is drawn through the plurality of air passages and into the plurality of mixing tubes by a pressure difference between the outside and inside of the plurality of mixing tubes;

a fan in communication with the plurality of air supply tubes; and at least one branch tube having a first end connected to the fan, and a second end connected to the plurality air supply tubes so as to distribute air from the fan to the plurality of air supply tubes.

* * * * *